US006858974B2

(12) United States Patent
Moriya et al.

(10) Patent No.: US 6,858,974 B2
(45) Date of Patent: Feb. 22, 2005

(54) SPARK PLUG FOR INTERNAL COMBUSTION ENGINE

(75) Inventors: Gakuji Moriya, Wako (JP); Kenichi Ishida, Wako (JP); Kazuyuki Kubo, Wako (JP); Toshihiro Ohkama, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/272,996

(22) Filed: Oct. 18, 2002

(65) Prior Publication Data

US 2003/0076022 A1 Apr. 24, 2003

(30) Foreign Application Priority Data

Oct. 23, 2001 (JP) ..... 2001-325394

(51) Int. Cl.[7] ..... H01T 13/20
(52) U.S. Cl. ..... 313/141; 313/143
(58) Field of Search ..... 313/140–143, 313/118; 445/7

(56) References Cited

U.S. PATENT DOCUMENTS 5,929,556 A * 7/1999 Matsubara et al. ..... 313/141

FOREIGN PATENT DOCUMENTS

JP 05-099956 4/1993
JP 2000-34969 A * 2/2000 ..... H01T/13/40

* cited by examiner

*Primary Examiner*—Joseph Williams
(74) *Attorney, Agent, or Firm*—Arent Fox PLLC

(57) ABSTRACT

A spark plug for internal combustion engine, which produces a spark discharge that ignites air-fuel mixture in the combustion chamber and causes combustion such that an ionic current flow during combustion can be utilized for detecting misfire of the engine. The spark plug the core connected to an ignition coil, a center electrode made of at least one of iridium and an iridium alloy and connected to the core through a seat, and a ground electrode separated from the center electrode with a gap. A sum of surface areas of the seat and the center electrode is not less than a prescribed value, specifically, is not less than 11.0 $mm^2$, and more specifically, is not less than 11.47 $mm^2$. Even when the diameter of the center electrode is reduced in the interest of improving ignition performance, improved ignition performance and improved ionic current detection accuracy can be achieved simultaneously.

7 Claims, 9 Drawing Sheets

SPARK PLUG FOR INTERNAL COMBUSTION ENGINE

BACKGROUND OF THE INVENTION

1. Field of the Invention

This invention relates to a spark plug, particularly to a spark plug that is installed to face into the combustion chamber of an internal combustion engine to ignite and burn an air-fuel mixture supplied into the combustion chamber and that is connected to an ion current detector for detecting ionic current arising during combustion of the air-fuel mixture.

2. Description of the Related Art

In a spark-ignition internal combustion engine, a high voltage generated by an ignition coil is applied through a distributor or the like to spark plugs installed in the individual cylinders. The spark discharge that the high voltages produces across the gap between the spark plug electrodes ignites the air-fuel mixture, causing combustion. However, when certain causes are present during the engine ignition/combustion stroke, the combustion of the air-fuel mixture does not proceed normally, i.e., misfire occurs.

When the air-fuel mixture burns normally, the combustion is accompanied by ionization of the air-fuel mixture (more precisely the combustion gas produced by normal burning of the air-fuel mixture). This generates ionic current at the gap between the center electrode and ground electrode of the spark plug. When misfire occurs and the air-fuel mixture does not burn, the air-fuel mixture does not ionize and no ionic current arises.

This has led to the common practice of detecting engine misfire by connecting an ion current detector to the spark plugs, detecting the ionic current produced in the combustion chambers at each combustion stroke, and comparing the detected value of the ionic current with a prescribed value.

Owing to the fact that the ionic current detection is conducted by detecting the value of the current generated at the gap between the center electrode and ground electrode of the spark plug in this manner, it is preferable for improving the detection accuracy to facilitate the flow of ionic current in the vicinity of the spark plug, particularly in the vicinity of the electrodes functioning as detection probes. The spark plug taught by Japanese Laid-Open Patent Application No. Hei 5(1993)-99956, for example, was developed for this purpose. In this spark plug, the surface area of a nickel (Ni) alloy center electrode exposed within the combustion chamber is defined to have an area of 25 $mm^2$ or greater so as to expand the contact area with the ionized combustion gas and thus facilitate the flow of ionic current.

In contrast to this, however, use of a small-diameter center electrode is preferable from the aspect of spark plug ignition performance, particularly in the points of mitigating flame quenching effect, enhancing antifouling performance, improving the ignition limit during lean-burn operation and lowering the discharge voltage (i.e., lowering the voltage required for ignition on the engine side). FIG. 8 shows how required center electrode diameter varies with lean-burn limit air/fuel ratio. FIG. 9 shows how required center electrode diameter varies with voltage required at ignition.

Recent years have therefore seen a move toward replacing the nickel and platinum (Pt) conventionally used as the material of the center electrode with iridium (Ir), a metal characterized by high melting point, high hardness and outstanding corrosion resistance. Today, therefore, wide use is made of spark plugs that achieve long service life despite having very fine electrode diameters on the order of 0.4 mm to 0.7 mm. When nickel is used as the center electrode material, the diameter is generally on the order of 2.5 mm.

Since the aforesaid prior art facilitates the flow of ionic current by setting the area of the center electrode to a large value, it cannot easily improve ionic current detection accuracy while also reducing center electrode diameter but ensuring satisfactory ignition performance.

SUMMARY OF THE INVENTION

An object of this invention is therefore to overcome the aforesaid problem by providing a spark plug that can achieve enhanced ionic current detection accuracy even when ignition performance is achieved by reducing the diameter of the center electrode, i.e., a spark plug that simultaneously improves both ignition performance and ionic current detection accuracy.

The present invention achieves the foregoing object by providing a spark plug comprising a spark plug installed to face into a combustion chamber of a cylinder of an internal combustion engine and to produce a spark discharge that ignites air-fuel mixture in the combustion chamber and causes combustion such that an ionic current flowing during combustion can be utilized for detecting misfire of the engine, comprising a core connected to an ignition coil, a center electrode made of at least one of iridium and an iridium alloy and connected to the core through a seat, and a ground electrode grounded at one and separated at other end from the center electrode with a gap. In the system, the improvement comprises a sum of surface areas of the seat the center electrode is defined as not less than a prescribed value.

BRIEF DESCRIPTION OF THE DRAWINGS

The object and advantages of the invention will be made apparent with reference to the following descriptions and drawings, in which.

DETAILED DESCRIPTION OF THE PREFERRED EMBODIMENT

A spark plug according to an embodiment of this invention will now be explained with reference to the attached drawings.

Figure 1:
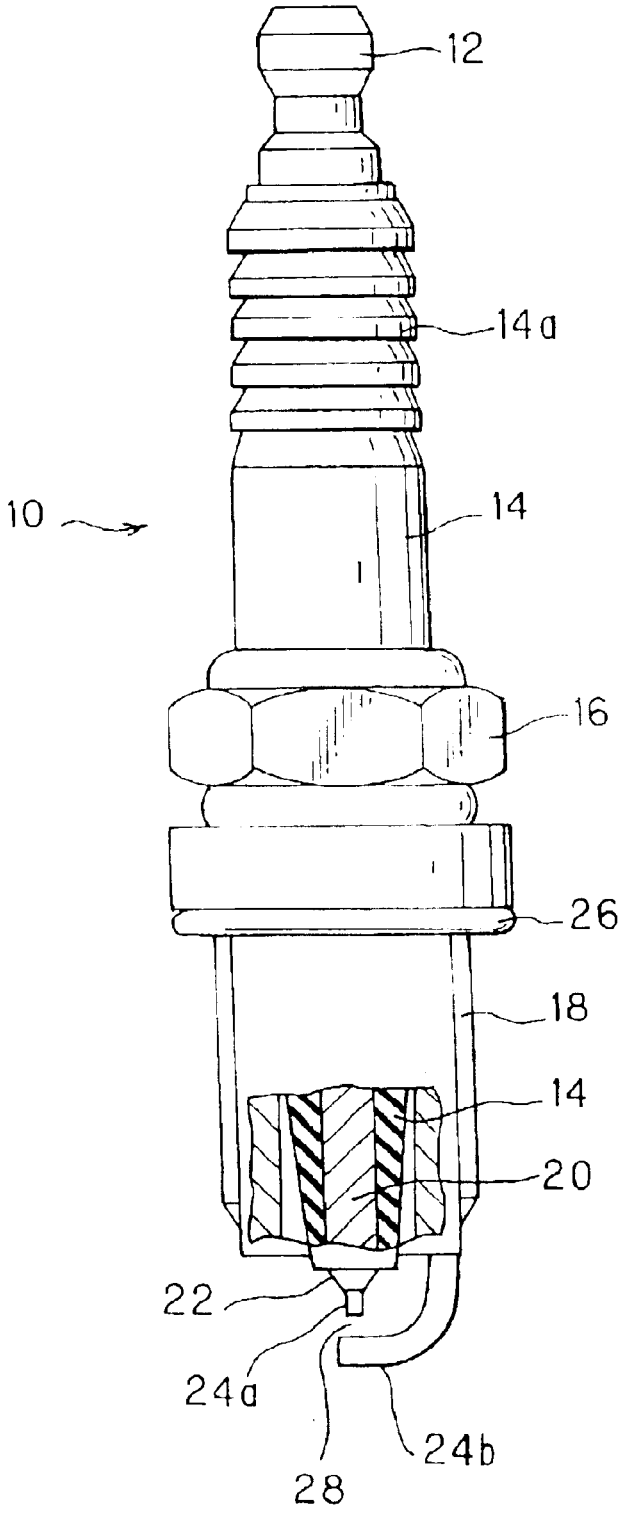
FIG. 1 is a front view of a spark plug according to an embodiment of the present invention.
Figure 2:
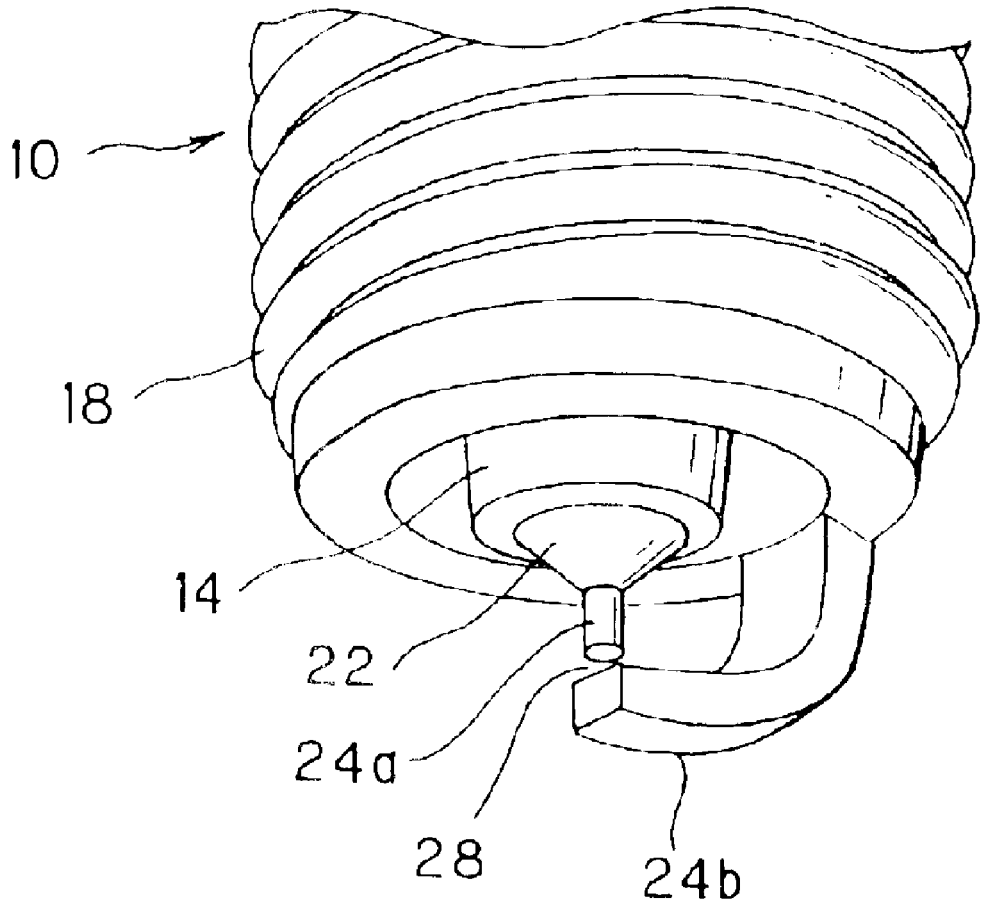
FIG. 2 is an enlarged perspective view of the vicinity of the electrodes of the spark plug shown in FIG. 1.

FIG. 1 is a front view of the spark plug according to this embodiment. FIG. 2 is an enlarged perspective view of the vicinity of the electrodes of the spark plug shown in FIG. 1. The spark plug, designated by reference numeral 10 in the drawings, is comprised chiefly of a terminal 12, insulator body (insulator) 14, shell head 16, threaded section 18 (illustrated in simplified form in FIG. 1), copper core 20 (a center shaft which is partially shown in cross-section), seat 22, center electrode 24*a*, and ground electrode (outer electrode) 24*b*.

The ceramic insulator body 14 is formed below (on the electrode side of) the terminal 12 so as to enclose the copper core 20. A corrugation 14*a* is formed above (on the terminal side of) the insulator body 14.

The hexagonal shell head 16 is formed around the insulator body 14 below the corrugation 14*a*. A gasket 26 is installed around the insulator body 14 on the underside of the shell head 16. The threaded section 18 for fastening the spark plug 10 in a cylinder head (discussed later) is formed below the gasket 26. The ground electrode 24*b*, typically made of platinum, is attached to the leading end of the threaded section 18 such as by welding. The attachment is done so as to establish a prescribed separation (gap 28) of, for instance, 1.1 mm between the center electrode 24*a* and the ground electrode 24*b*.

Figure 3:
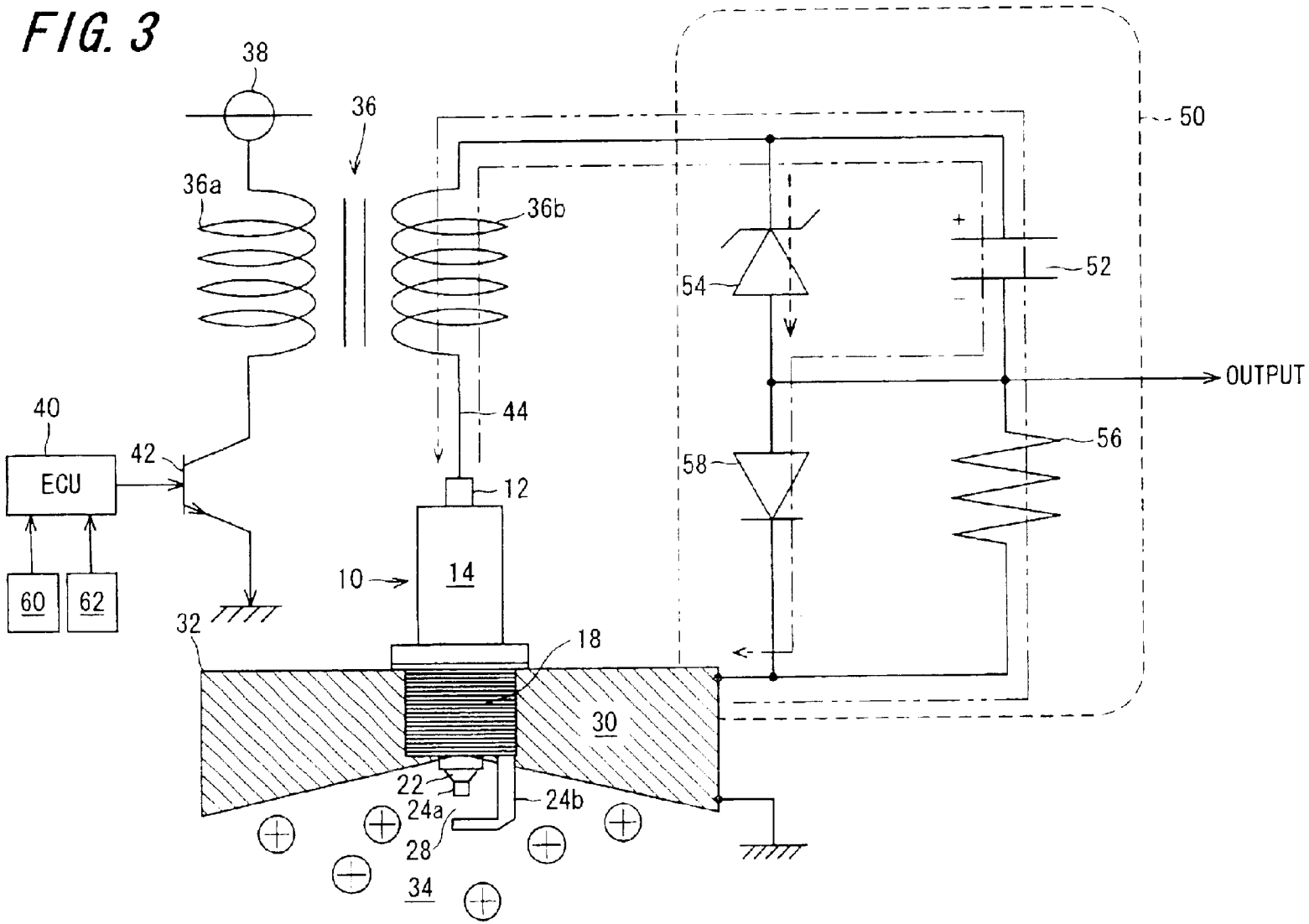
FIG. 3 is a circuit diagram showing detection of ionic current using the spark plug illustrated in FIG. 1.

Detection of ionic current using the spark plug 10 will now be briefly explained with reference to FIG. 3. The spark plug 10 is connected to an ignition circuit for producing a spark discharge and to an ionic current detection system for detecting the ionic current that occurs during combustion. FIG. 3 shows only the circuitry associated with the ionic current detection circuit.

As shown, the spark plug 10 is installed to face into a combustion chamber 34 of a cylinder 32 (represented in the figure by a portion of a cylinder head 30) of an internal combustion engine. (Although the spark plug 10 and associated circuitry are shown only for one cylinder 32, the other cylinders are also similarly equipped.) The seat 22, center electrode 24*a* and ground electrode 24*b* are exposed within the combustion chamber 34.

The primary side (low-voltage side) coil (winding) 36*a* of an ignition coil (winding) 36 for producing a discharge voltage at the spark plug 10 is connected at one end to an electric power source (onboard battery) 38 and at the other to ground through a power transistor 42 that is switched by an ignition signal from an ECU (Electronic Control Unit) 40.

One end of the secondary side (high-voltage side) coil (winding) 36*b* of the ignition coil (winding) 36 is connected through a high-tension cord 44 to the terminal 12 of the spark plug 10 and, in turn, to the copper core 20 (not shown in FIG. 3), seat 22 and center electrode 24*a*. The ground electrode 24*b* is grounded through the cylinder head 30.

The other end of the secondary coil (winding) 36*b* of the ignition coil (winding) 36 is connected to an ionic current detector 50. The current detector 50 comprises a parallel connection of a capacitor 52 charged in the indicated polarity by discharge current and a Zener diode 54 that regulates the charging voltage of the capacitor 52, a detection resistor 56 through which the capacitor 52 is connected to ground, and a diode 58 for preventing reverse current flow through which the Zener diode 54 is connected to ground.

The ECU 40 comprises a microcomputer. It is input with the outputs of a group of sensors, including a crank angle sensor 60 that is installed near the crankshaft or camshaft (neither shown) and outputs a signal representing the TDC position of the cylinders and subdivided crank angles thereof, an absolute pressure sensor 62 that outputs a signal representing the manifold absolute pressure (PBA) in an air intake pipe, and other sensors not shown in the drawing.

The operation of the illustrated arrangement will now be explained. The flow of current from the power source 38 through the primary coil (winding) 36*a* is switched (turned ON and OFF) by the power transistor 42 in response to the ignition signal (ignition command) from the ECU 40.

When the current flow through the primary coil (winding) 36*a* is stopped by switching of the power transistor 42 from ON to OFF, a high voltage of negative polarity (discharge voltage) is concurrently produced in the secondary coil (winding) 36*b*. Discharge current therefore flows as indicated by the alternate long and short dashed line in FIG. 3. Specifically, current flowing through the path of the spark plug 10→secondary coil 36*b*→capacitor 52 (or Zener diode 54)→diode 58 produces a spark discharge across the gap 28 of the spark plug 10 that ignites the air-fuel mixture and causes combustion.

In addition, the discharge current charges the capacitor 52 in the polarity shown in the drawing. When charged, the capacitor 52 functions as an ionic current detection power source providing a bias voltage for detecting ionic current and leak current.

During the combustion of the air-fuel mixture set off by the spark discharge at the gap 28 of the spark plug 10, the air-fuel mixture (more precisely the combustion gas produced by burning of the air-fuel mixture) ionizes. The ions produced migrate owing to the effect of the bias voltage of the capacitor 52 and their resulting presence at the gap 28 separating the seat 22 and center electrode 24*a* from the ground electrode 24*b* lowers the electrical resistance at the gap 28. As a result, ionic current flows through the path of the detection resistor 56→capacitor 52→secondary coil (winding) 36*b*→spark plug 10, as indicated by the alternate long and two short dashed line in FIG. 3. The ionic current occurring at this time changes the voltage drop across the detection resistor 56. The ionic current detector 50 outputs this voltage change, i.e., the ionic current waveform, to the ECU 40 through a waveform shaping circuit (not shown).

The ECU 40 calculates an ignition timing based on the input values from the crank angle sensor 60, manifold absolute pressure sensor 62 and other sensors, and produces an ignition command at the calculated timing. It also discriminates whether or not the engine is in a misfire state (conducts misfire detection) based on the received ionic current waveform. As the particulars of these operations of the ECU 40 are not directly related to the substance of this invention, they will not be explained in detail.

The explanation will now be continued with reference to FIGS. 1 and 2. The copper core 20 is connected to the terminal 12 at one end and at the other end to the conical seat 22, which has the shape of a truncated cone. The seat 22 is made of a material excelling in heat resistance, corrosion resistance and electrical conductivity. It can, for example, be made of Inconel®, a nickel-based alloy containing chromium, iron, carbon and other elements produced by Inco Alloys International, Inc. The center electrode 24*a* is a cylindrical body measuring 0.7 mm in diameter and 1.1 mm in length (height) made of iridium or an iridium alloy. It is attached to the seat 22 by welding.

A continuous electrically conductive path is thus established for the discharge voltage from the terminal 12 to the center electrode 24*a*. While, as pointed out earlier, the practice is to define the diameter of an iridium center electrode between approximately 0.4 mm and 0.7 mm, the diameter is set at 0.7 mm in this embodiment in consideration of durability and machinability.

The characteristics of the iridium center electrode 24*a* will be briefly explained. As mentioned earlier, iridium has a higher melting point and higher hardness than nickel or platinum, and is also excellent in corrosion resistance. Therefore, when the center electrode of a spark plug is made of iridium, it can be made very fine while still ensuring satisfactory spark plug service life. The diameter of an iridium center electrode can, for example, be reduced to one-third or less that of an ordinary nickel center electrode. This mitigates the flame quenching effect by reducing center electrode area, stabilizes the discharge point by narrowing the tip of the center electrode, and lowers the discharge voltage by intensifying the electric field.

Figure 8:
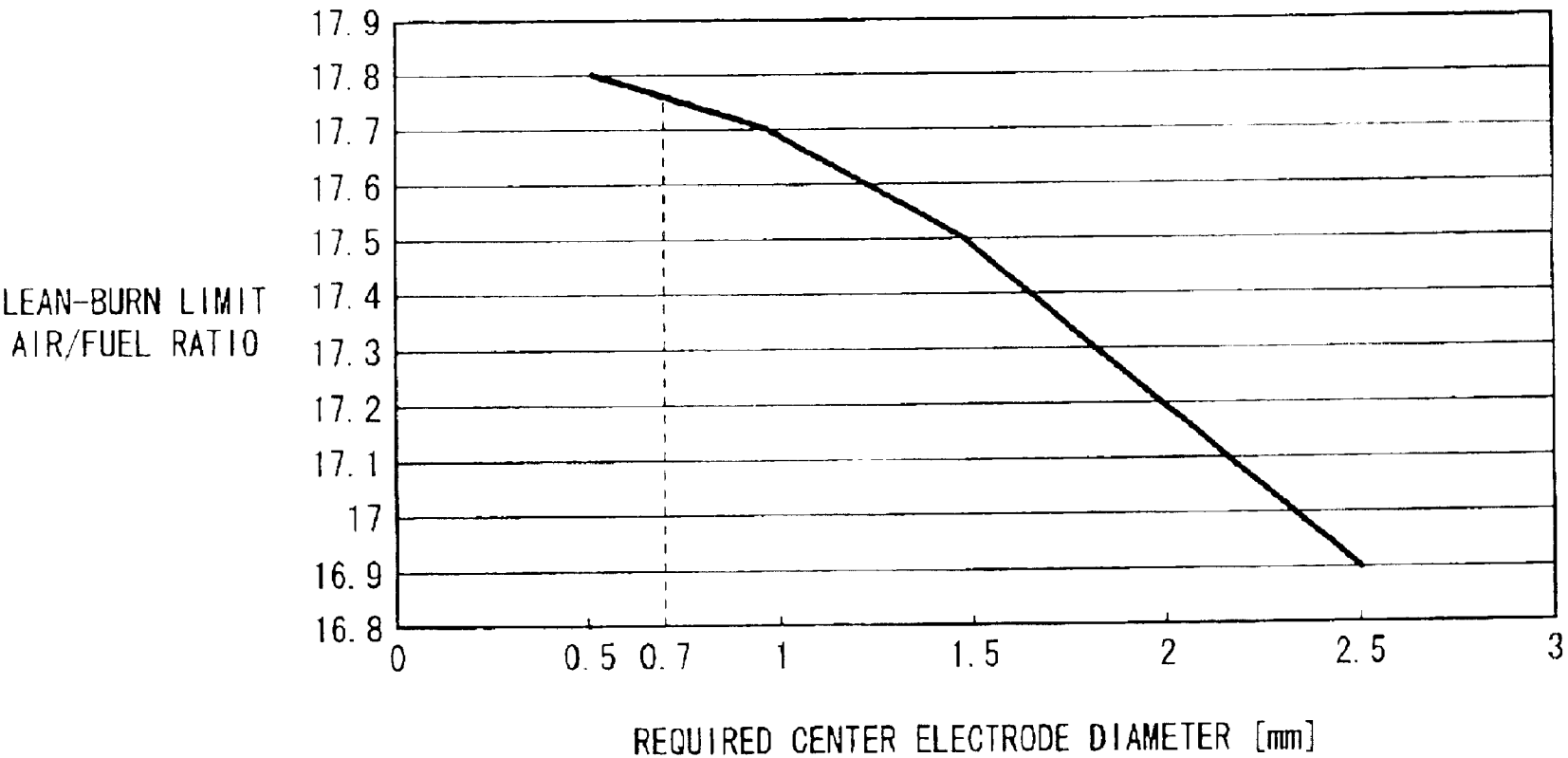
FIG. 8 is a graph showing how required center electrode diameter varies with lean-bum limit air/fuel ratio.
Figure 9:
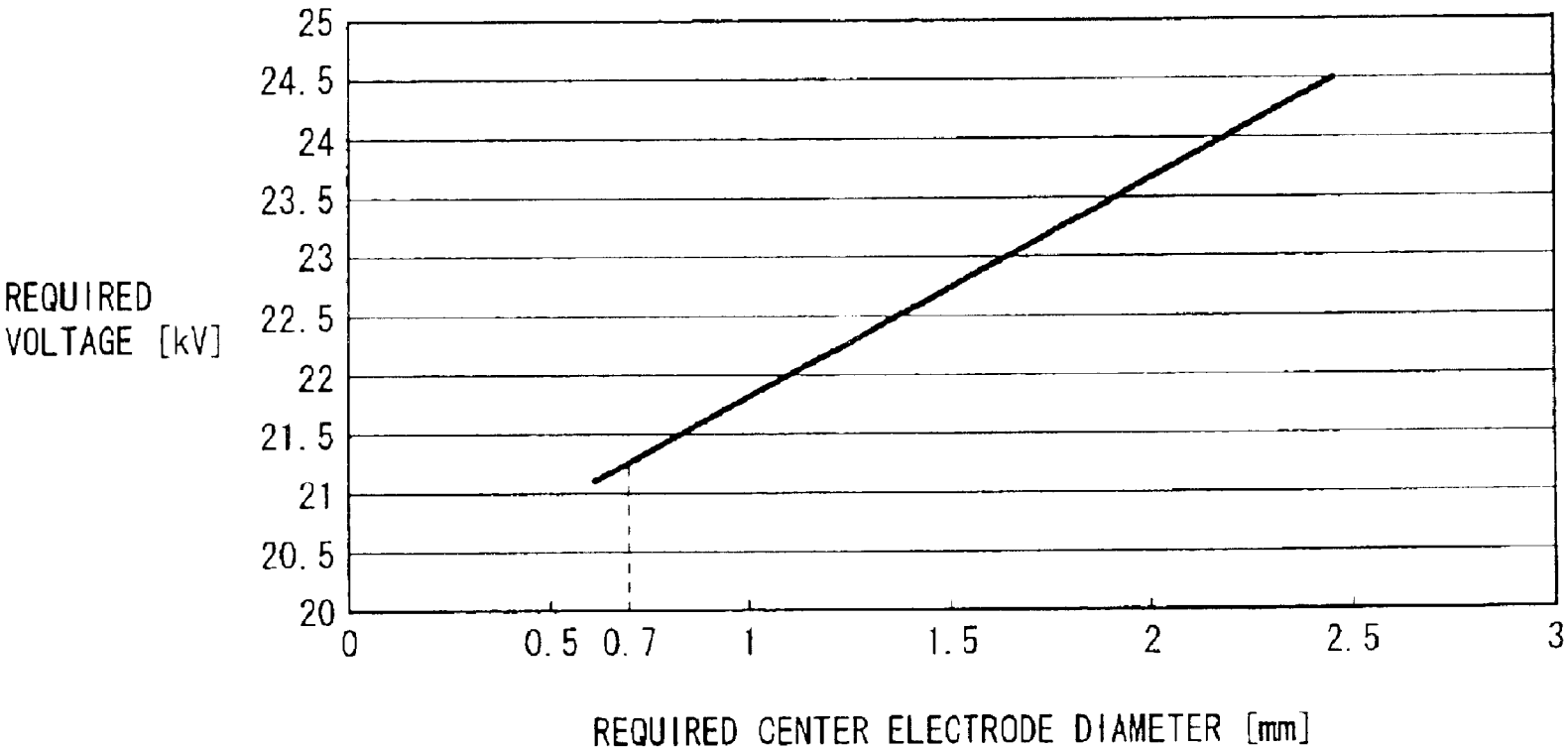
FIG. 9 is a graph showing how required center electrode diameter varies with voltage required at ignition.

Owing to these and other advantages, engine starting performance is enhanced and stable ignition performance can be achieved over a broad range of engine speeds extending from idling to high rpm operation. The broken lines in FIGS. 8 and 9 indicate the lean-burn limit air/fuel ratio and the required voltage of the spark plug 10 of this embodiment (i.e., a spark plug having a 0.7 mm-diameter center electrode).

As explained earlier, the occurrence of ionic current is detected by detecting current produced at the gap between the center electrode and ground electrode of the spark plug. In order to upgrade the detection accuracy, therefore, it is necessary to facilitate the flow of ionic current at the spark plug, particularly in the region of the electrodes that serve as the probes for the detection.

What characterizes this embodiment is that the sum of the surface areas of the seat 22 and the center electrode 24*a* is defined as not less than a prescribed value, specifically not less than 11.0 $mm^2$, more specifically not less than 11.47 $mm^2$. As explained earlier, the center electrode 24*a* and seat 22 are exposed within the combustion chamber 34 and are components having electrical conductivity.

From this it follows that even if the surface area of the center electrode is decreased because the diameter of the center electrode 24*a* is reduced in order to enhance ignition performance, the ionic current detection accuracy can nevertheless be increased by increasing the surface area of the seat 22 by the amount of the decrease in center electrode surface area. The values of 11.0 $mm^2$ and more specifically not less than 11.47 $mm^2$ cited above were determined through tests conducted by the inventors as surface areas of the seat and the center electrode that enable good ionic current detection when an iridium center electrode is used.

In this embodiment, the surface area of the seat 22 is 8.67 $mm^2$ and the surface area of the center electrode 24*a* is 2.80 $mm^2$. As was stated earlier, the center electrode 24*a* in this embodiment is a cylinder having a diameter of 0.7 mm and a length (height) of 1.1 mm. The surface area of the center electrode 24*a* is approximately 2.80 $mm^2$. Only the regions of the center electrode 24*a* exposed within the combustion chamber 34 are included in this calculation, i.e., of the circular areas of top and bottom faces (as viewed in FIGS. 1 and 3) of the cylindrical body, that of the top face in contact with the seat 22 is not included in the calculated area. The surface area of the seat 22 (only the area exposed within the combustion chamber 34 and not including areas in contact with the center electrode 24*a* and the copper core 20) is therefore defined as 8.67 $mm^2$, the value obtained by subtracting 2.80 $mm^2$ from 11.47 $mm^2$.

In an ordinary spark plug of the prior art having a center electrode like that of this embodiment (diameter of 0.7 mm, length (height) of 1.1 mm), the sum of the surface areas of the seat and center electrode is about 7.82 $mm^2$. Since the surface area of the center electrode of the conventional spark plug is the same as that of this embodiment, the surface area of the seat is 5.02 $mm^2$, the value obtained by subtracting 2.80 $mm^2$ from 7.82 $mm^2$. The surface area of the seat 22 of the spark plug 10 of this embodiment can therefore be seen to be larger than that of the seat of the conventional spark plug.

Figure 4:
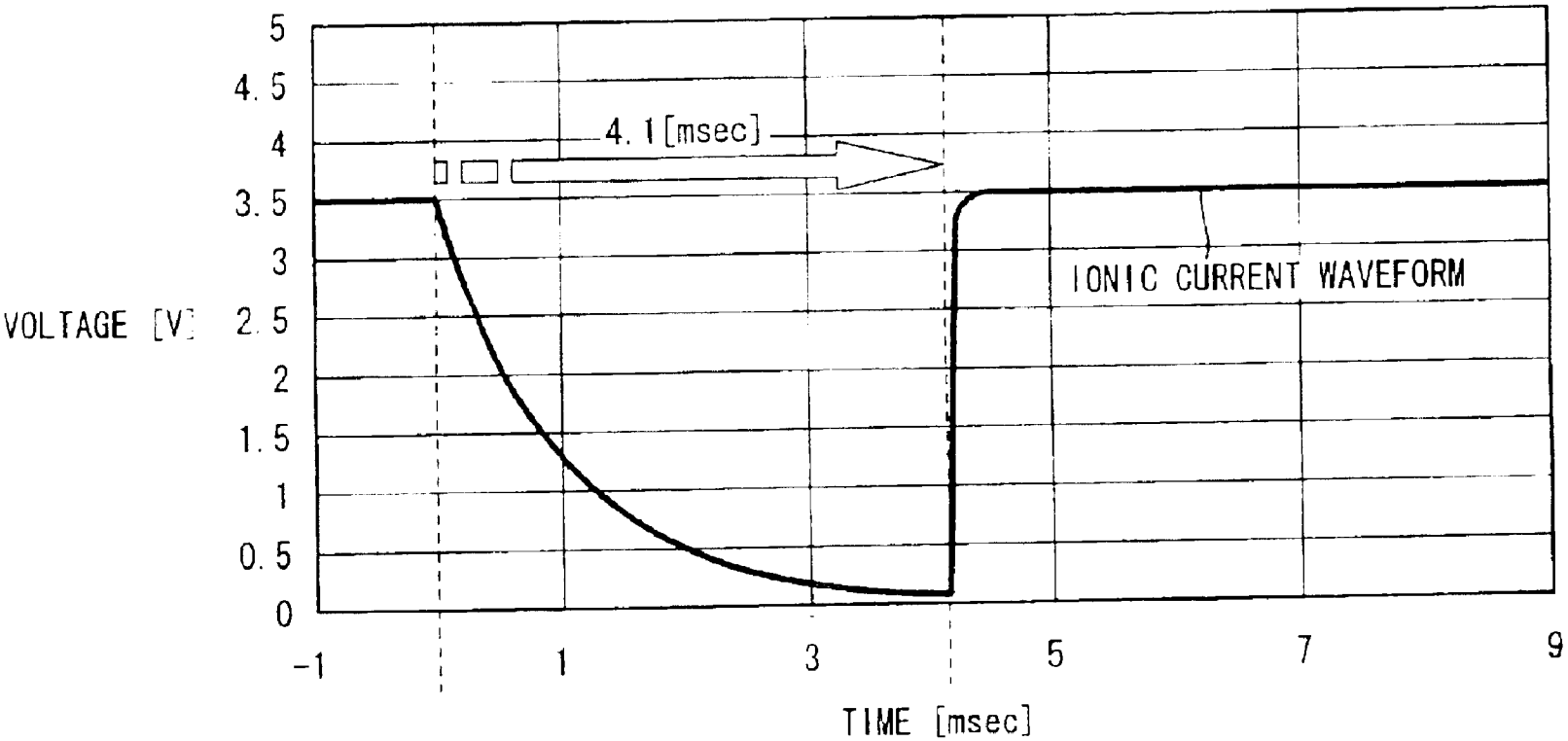
FIG. 4 is a graph showing an ionic current waveform obtained by the ionic current detection circuit with the use of the spark plug illustrated in FIG. 1.
Figure 5:
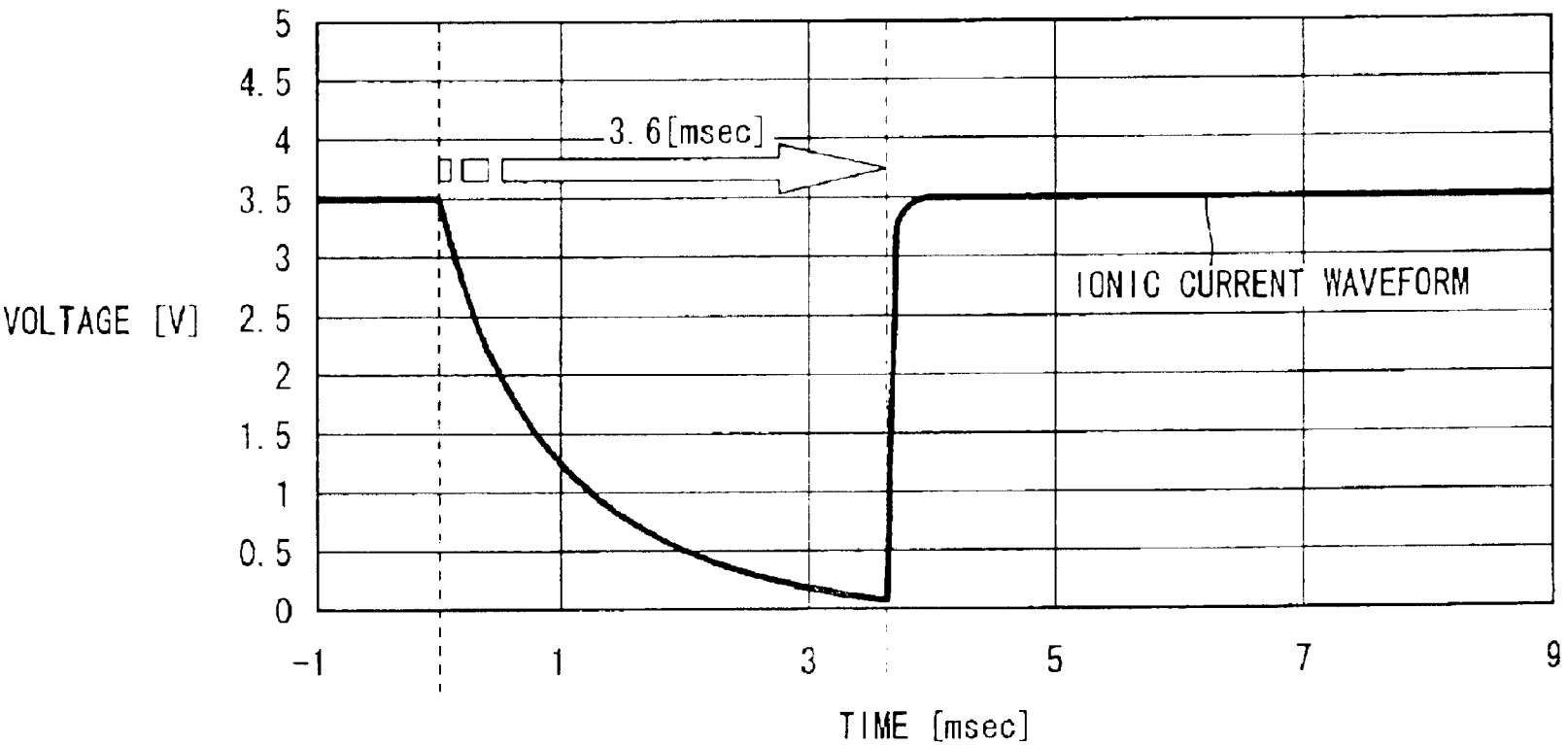
FIG. 5 is a view, similar to FIG. 4, but showing an ionic current waveform obtained when using a prior art spark plug.

FIG. 4 shows an ionic current waveform obtained when using the spark plug 10 of this embodiment. FIG. 5 shows an ionic current waveform obtained when using a prior art spark plug (having a center electrode of 0.7 mm diameter and 1.1 mm length (height), with 7.82 $mm^2$ of combined seat and center electrode surface area; the spark plug not being illustrated in the drawings because the spark plug itself is identical in structure and form to the spark plug 10 shown in FIGS. 1 and 2). The ionic current waveforms shown in FIGS. 4 and 5 (and those in shown in FIGS. 6 and 7 shown later) are ones output by the ionic current detector 50 and input to the ECU 40 through a waveform shaping circuit (not shown) when the internal combustion engine is operating at 3,000 rpm.

A comparison of the two figures shows that the output period of the ionic current waveform of the spark plug 10 of this embodiment (4.1 msec) was longer than that of the conventional spark plug (3.6 msec). This demonstrates that the ionic current detection accuracy when using the spark plug 10 is superior to that when using the conventional spark plug.

Figure 6:
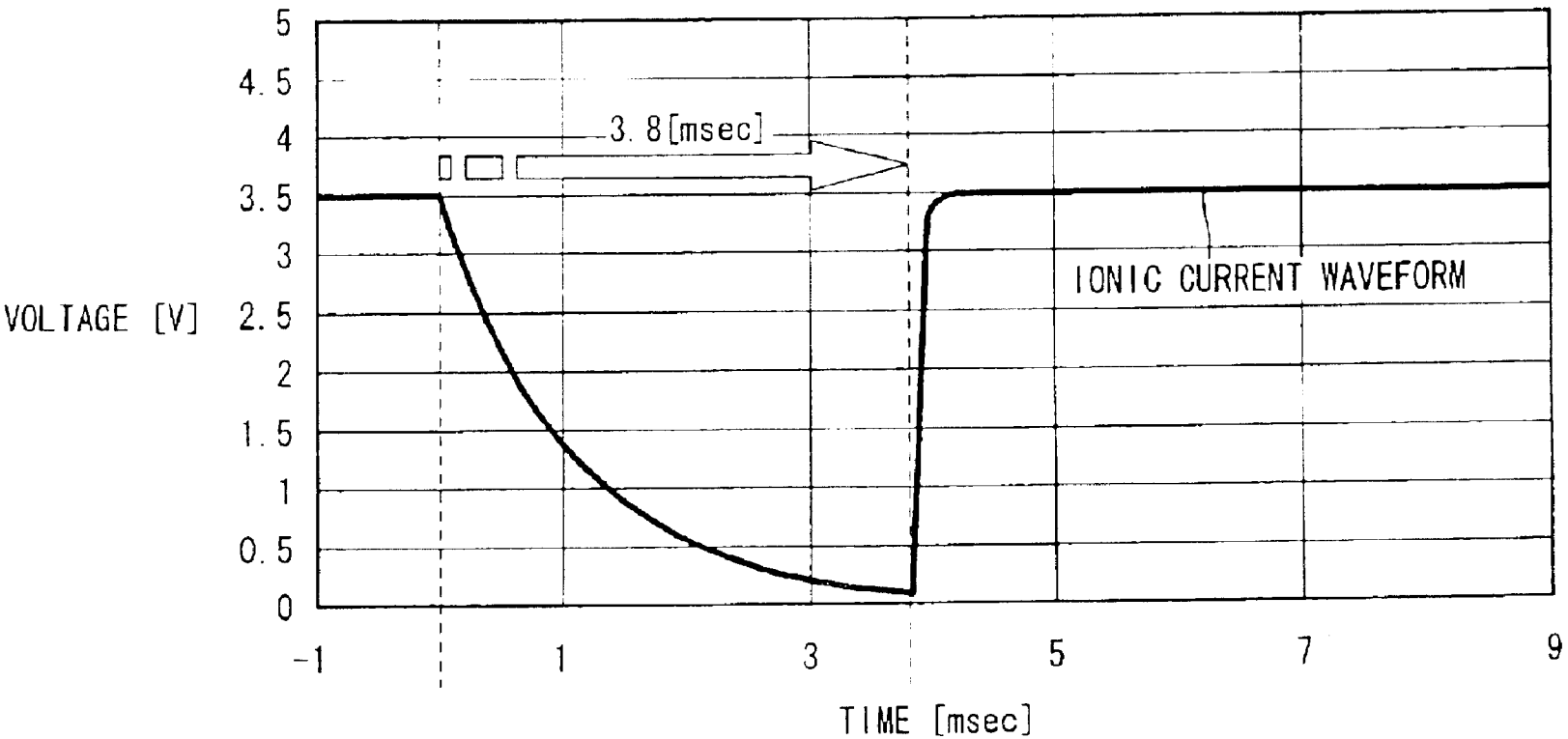
FIG. 6 is a graph showing another ionic current waveform obtained using the spark plug illustrated in FIG. 1.
Figure 7:
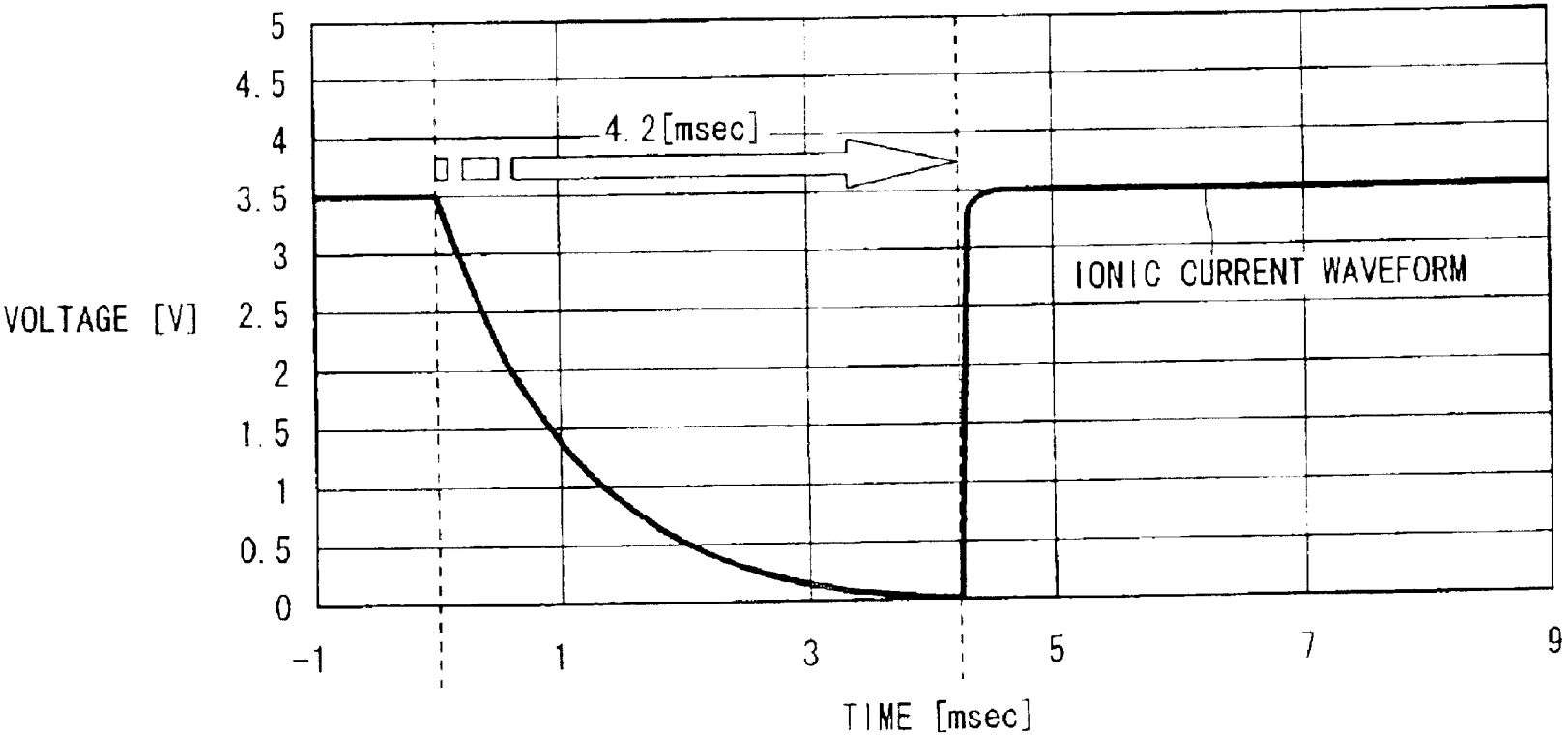
FIG. 7 is a graph showing an ionic current waveform obtained using a spark plug whose center electrode surface area was increased relative to that of spark plug illustrated in FIG. 1 and whose seat surface area was decreased by the amount of the increase.

FIG. 4 will be further compared with FIG. 6 and FIG. 7. FIG. 6 shows an ionic current waveform obtained using a spark plug whose combined seat and center electrode surface area and center electrode length were the same as those of the spark plug 10 (i.e., had a combined seat and center electrode surface area of 11.47 $mm^2$ and a center electrode length of 1.1 mm) but whose center electrode diameter was reduced to 0.4 mm (the spark plug not being illustrated in the drawings because it is identical to the spark plug 10 shown in FIGS. 1 and 2). In other words, FIG. 6 shows an ionic current waveform obtained using a spark plug whose center electrode surface area was decreased relative to that of the spark plug 10 and whose seat surface area was increased by the amount of the decrease.

Oppositely from FIG. 6, FIG. 7 shows an ionic current waveform obtained using a spark plug whose combined seat and center electrode surface area and center electrode length were the same as those of the spark plug 10 but whose center electrode diameter was increased to 0.8 mm (the spark plug not being illustrated in the drawings because it is identical to the spark plug 10 shown in FIGS. 1 and 2). In other words, FIG. 7 shows an ionic current waveform obtained using a spark plug whose center electrode surface area was increased relative to that of spark plug 10 and whose seat surface area was decreased by the amount of the increase.

Specifically, the ionic current waveform shown in FIG. 6 was obtained using a spark plug whose center electrode surface area was 1.51 $mm^2$ and seat surface area was 9.96 $mm^2$ for the same combined area of 11.47 $mm^2$ as that of the spark plug 10. The ionic current waveform shown in FIG. 7 was obtained using a spark plug whose center electrode surface area was 3.27 $mm^2$ and seat surface area was 8.20 $mm^2$ for the same combined area of 11.47 $mm^2$ as that of the spark plug 10.

Comparing FIG. 4 with FIGS. 6 and 7, it will be noted that the durations of the ionic current waveforms did not differ markedly (3.8 msec in FIGS. 6 and 4.2 msec in FIG. 7 as compared with 4.1 msec in FIG. 4). In other words, so long as the sum of the seat surface area and the center electrode surface area is equal to or greater than the prescribed value, the breakdown (ratio) between the seat surface area and the center electrode surface area does not appreciably affect the ionic current detection accuracy. The ratio between the seat surface area and the center electrode surface area can therefore be set as desired. For instance, in a case where reduction of the center electrode diameter is found to degrade the ionic current detection accuracy owing to the decrease in the center electrode surface area, the desired ionic current detection accuracy can be obtained by increasing the seat surface area so as to cover for the decrease in the center electrode surface area.

Thus when the diameter of the center electrode is reduced in order to enhance ignition performance, the resulting decrease in the surface area of the center electrode is made up for by increasing the surface area of the seat on which the center electrode is mounted so as to obtain the prescribed sum of the two areas, specifically so as to bring their sum up to 11.0 $mm^2$ and more specifically up to 11.47 $mm^2$, thereby achieving simultaneous improvements in the ionic current detection accuracy and the ignition performance.

As explained in the foregoing, this invention is characterized in that it requires the sum of the seat surface area and the center electrode surface area to be not less than a prescribed value, specifically not less 11.0 $mm^2$ and more specifically not less than 11.47 $mm^2$. The spark plugs that exhibited the characteristics shown in FIGS. 6 and 7 can therefore also be called embodiments of the invention.

In particular, the spark plug whose characteristic is shown in FIG. 6 had a longer ionic current duration than the conventional spark plug whose characteristic is shown in FIG. 5 despite the fact that it had a small diameter center electrode. This even more positively underscores the fact that ionic current detection accuracy can be enhanced by making up for the decrease in the center electrode surface area by increasing the seat surface area by the amount of the decrease (or by an even greater amount) so as to make the sum of the areas equal to or greater than the prescribed value.

In the convention spark plug, the seat is only required to enable mounting of the center electrode. The tendency is, therefore, to reduce the seat surface area in proportion as the diameter of the center electrode is reduced. In other words, the conventional spark plug cannot be expected to achieve the effects offered by the invention.

While the material of the ground electrode was specified as platinum in the foregoing description, it is not limited to platinum. Moreover, the structure of the spark plug is not limited to that described and can be any of various other types such as the resistor type.

Further, the seat is not limited to the described shape can be any of various other shapes insofar as the prescribed surface area can be obtained. In addition, the material of the seat is not limited to that specified above but can be any of various other materials that are excellent in heat resistance, corrosion resistance and electrical conductivity.

The embodiment is thus configured to have a spark plug 10 installed to face into a combustion chamber 34 of a cylinder of an internal combustion engine and to produce a spark discharge that ignites air-fuel mixture in the combustion chamber and causes combustion such that an ionic current flowing during combustion can be utilized for detecting misfire of the engine, comprising; a core (copper core) 20 connected to an ignition coil; a center electrode 24*a* made of at least one of iridium and an iridium alloy and connected to the core through a seat 22; and a ground electrode 24*b* grounded at one and separated at other end from the center electrode with a gap 28; wherein the improvement comprises: a sum of surface areas of the seat and the center electrode is defined as not less than a prescribed value.

Thus, even when the diameter of the center electrode is reduced in the interest of improving ignition performance, the ionic current detection accuracy can nevertheless be enhanced by setting the sum of the seat surface area and the center electrode surface area to a prescribed value. In other words, improved ignition performance and improved ionic current detection accuracy can be achieved simultaneously.

The entire disclosure of Japanese Patent Application No. 2001-325394 filed on Oct. 23, 2001, including specification, claims, drawings and summary, is incorporated herein in reference in its entirety.

While the invention has thus been shown and described with reference to specific embodiments, it should be noted that the invention is in no way limited to the details of the described arrangements but changes and modifications may be made without departing from the scope of the appended claims.

What is claimed is:

1. A spark plug installed to face into a combustion chamber of a cylinder of an internal combustion engine and to produce a spark discharge that ignites air-fuel mixture in the combustion chamber and causes combustion such that an ionic current flowing during combustion can be utilized for detecting misfire of the engine, comprising:

a core connected to an ignition coil;

a center electrode made of at least one of iridium and an iridium alloy and connected to the core through a seat; and a ground electrode grounded at one and separated at other end from the center electrode with a gap;

wherein the improvement comprises:

a sum of surface areas of the seat the center electrode is defined as not less than a prescribed value and remains unchanged when the surface area of the center electrode is decreased by increasing the surface area of the seat relative to the amount of the decrease, and when the surface area of the center electrode is increased by decreasing the surface area of the seat relative to the amount of the increase.

2. A spark plug according to claim 1, wherein the prescribed value is not less than 11.0 $mm^2$.

3. A spark plug according to claim 2, wherein the prescribed value is not less than 11.47 $mm^2$.

4. A spark plug according to claim 3, wherein the surface area of the seat is 8.67 $mm^2$ and the surface area of the center electrode is 2.80 $mm^2$.

5. A spark plug according to claim 3, wherein the center electrode is a cylinder having a diameter of 0.7 mm and a length of 1.1 mm.

6. A spark plug according to claim 1, wherein the seat is a shape of truncated cone.

7. A spark plug according to claim 6, wherein the seat is made of a nickel-based alloy.

* * * * *

UNITED STATES PATENT AND TRADEMARK OFFICE

CERTIFICATE OF CORRECTION

PATENT NO. : 6,858,974 B2
DATED : February 22, 2005
INVENTOR(S) : Moriya et al.

It is certified that error appears in the above-identified patent and that said Letters Patent is hereby corrected as shown below:

Column 8,
Line 42, please amend to read:
-- a sum of surface areas of the seat and the center electrode is --.

Signed and Sealed this

Sixteenth Day of August, 2005

JON W. DUDAS
*Director of the United States Patent and Trademark Office*